United States Patent [19]

Kofink

[11] 4,015,912

[45] Apr. 5, 1977

[54] ELECTROMAGNETIC PUMPING DEVICE FOR LIQUIDS

[75] Inventor: Siegfried Kofink, Zell (Neckar), Germany

[73] Assignee: J. Eberspacher, Germany

[22] Filed: Mar. 20, 1975

[21] Appl. No.: 560,494

[30] Foreign Application Priority Data

Mar. 23, 1974 Germany ..... 2414165

[52] U.S. Cl. ..... 417/417; 361/174; 361/175

[51] Int. Cl.[2] ..... F04B 17/04

[58] Field of Search ..... 417/413, 417; 317/124, 317/125, 128

[56] References Cited

UNITED STATES PATENTS

| | | | |
|---|---|---|---|
| 2,638,849 | 5/1953 | Budlane | 417/413 |
| 2,953,689 | 9/1960 | Becker | 317/124 X |
| 3,227,929 | 1/1966 | McCreight | 317/124 X |
| 3,273,505 | 9/1966 | Miles | 417/413 |
| 3,411,704 | 11/1968 | Hilgert | 417/326 |
| 3,673,414 | 6/1972 | Taniguchi | 317/124 X |

*Primary Examiner*—C. J. Husar
*Attorney, Agent, or Firm*—McGlew and Tuttle

[57] ABSTRACT

An electromagnetic pumping device for liquids particularly for feeding liquid fuel in combustion devices, comprises a housing having a pumping chamber with an inlet to the pumping chamber and a discharge from the pumping chamber and with a pumping diaphragm in the chamber having a magnetic armature with a piston rod portion which is actuated by a power circuit having a photoelectric switch therein which is turned on and off by the movement of an aperture in the rod portion of the switch past the photoelectric cell so that the armature and the pumping diaphragm are moved in accordance therewith to pump the liquid.

6 Claims, 2 Drawing Figures

ELECTROMAGNETIC PUMPING DEVICE FOR LIQUIDS

FIELD AND BACKGROUND OF THE INVENTION

This invention relates in general to the construction of pumps and, in particular, to a new and useful electromagnetic pump for pumping liquid fuels which includes a diaphragm which is actuated by the attraction and release of an armature under the control of a photoelectric cell which is operated by the movement of an aperture in a piston rod portion of the armature past a photoelectric cell.

DESCRIPTION OF THE PRIOR ART

Electromagnetic pumping devices for transporting liquids are known. They are usually used in motor vehicles in connection with heating devices which operate independently of the vehicle engine and must provide a finely dosed fuel feed. In the known electromagnetic pumps for this operation, the control is preferably effected by means of mechanical component parts, for example, by use of a tumbler switch connected to a piston rod. The disadvantages of the known devices are particularly that they have a relatively short life, due to the wearing of the mechanical parts, and they have a high power consumption. In addition, they cannot be readialy adjusted to supply small fuel quantities.

In order to obtain electromagnetic pumps which work noiselessly which have a substantially longer life and a low power consumption or high efficiency, it has been proposed to control the pumps so that, for example, on the rotating part of a worm gear driven by an electromotor, a permanent magnet is mounted for cooperation with a magnetic switch or a controllable resistance. In such an arrangement, the base of a transistor is controlled through the operation of the magnetic switch in order to effect an electromagnetic metering operation of the pump from the magnetic impulses which are supplied. Due to their long life and more accurate switching, such controls are suitable particularly for evaporation burners which are used in motor vehicles, for example, for heating devices which operate independently of the vehicle engine.

SUMMARY OF THE INVENTION

The present invention provides an improved electromagnetic pumping device for combustible liquids, in which no tumbler elements are required and, consequently, no mechanical wear takes place. In addition, the device is operable with a short stroke at high frequencies and the stroke of the device is adjustable. For this purpose, in accordance with the invention, an electromagnetic armature is formed as a connection to, or as a part of a piston rod of the pump, and this piston rod is provided with an aperture which is movable during its stroke operational range past a photodiode, which is mounted on one side of the aperture, and a photovoltaic cell which is mounted on the other side of the aperture. The arrangement provides a photoelectric switching operation of a control circuit for the electromagnet which is periodically energized and de-energized by the movement of the piston rod and the aperture therein past the photoelectric cells. Each time the circuit is closed, the armature is attracted and the diaphragm with the piston rod is moved and the fuel is delivered. Upon a subsequent interruption of the current which is caused by the movement of the aperture to a position in which the light beam is broken or covered up, the piston is moved back due to the action of a reset spring. This in turn causes a movement of the aperture back past the photodiode so that another electrical impulse is imparted to the electromagnet to move the armature once more. With the construction, it has been found useful to provide a separate rod element connected to the magnetic armature which is affixed to the diaphragm of the pump. The rod portion reciprocates within the range of the photodiode and photovoltaic cell to periodically move its aperture into and out of alignment therewith. The aperture can be controlled both as to size and location so that the highest accuracy in operation can be obtained.

In order to be able to vary the stroke of the electromagnetic pumping device of the invention, it has been found advantageous to provide the piston rod with a slot at its end and with an external thread on a part thereof so that the location of the slot may be varied in respect to the length of the associated rod by varying the threading interengagement of the two parts. The basic control of the invention is obtained by a fixed position of the photoelectric switching device in a settable position of the aperture in the movable piston rod portion of the pump.

Accordingly, it is an object of the invention to provide an electromagnetic pump which includes a flexible diaphragm which is movable to pump liquid under the control of an electromagnet which has a rod portion with an aperture which moves past a photoelectric switch of a control circuit which is connected to energize the electromagnet whenever the aperture is aligned with the photocell switch, and which also includes switch spring means to return the armature diaphragm to a non-actuated position.

A further object of the invention is to provide an electromagnetic pump which is simple in design, rugged in construction, highly precise in operation, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
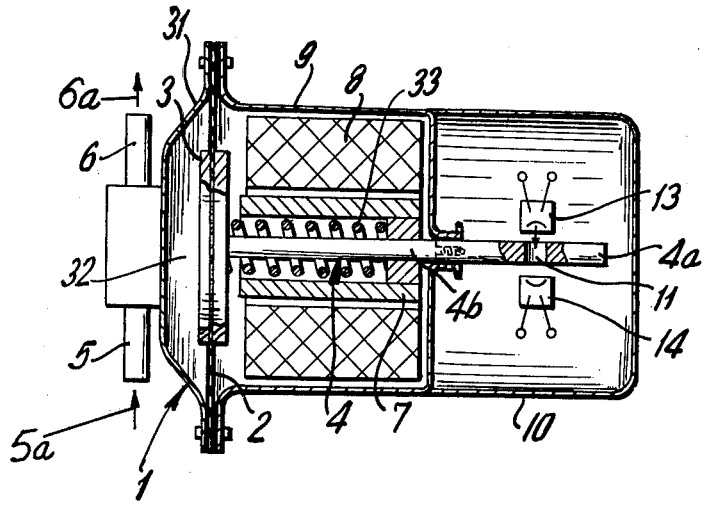
FIG. 1 is an axial sectional view of an electromagnetic pump constructed in accordance with the invention.

Referring to the drawing in particular, the invention embodied therein, comprises an electromagnetic pump, generally designated 1, which includes a housing having a first portion 9 with an outer cap 10, and a second portion 31 which is flanged to the portion 9 over a flexible diaghragm 2 which is arranged in an end of a pumping space 32. Pumping space 32 communicates with an inlet fitting 5 at one end and with a discharge fitting 6 at an opposite end, and fuel is taken in at the inlet 5 and discharged out through discharge 6 upon the flexing operation of diaphragm 2. Suitable check valves in inlet fitting 5 and discharge 6 permit flow only in directions of the arrows 5*a* and 6*a*, respectively, where the diaphragm moves in the pump space 32.

In accordance with the invention, the diaphragm includes an armature which has a plate portion 3 which is affixed to the diaphragm 2 and which, in the embodiment illustrated, extends transversely to a piston rod part 4. Piston rod part 4 extends through the center of an electromagnet core 7 which is surrounded by an actuating coil 8. A return spring 33 acts continuously on the armature 3 to move it outwardly from the core 7 and thereby to return it to a non-actuated position.

In accordance with a feature of the invention, the pump is continuously operated by an electrical control circuit, generally designated 34, which includes photocell switching means in the form of a photocell diode 13 arranged in opposition to a photovoltaic cell 14 on respective sides of a free end 4*a* of the piston rod portion 4. The circuit 34 includes a power source such as a battery 35.

In order to provide a continuous operation of the device, rod portion 4 is provided with an aperture 11 which may be aligned between the diode 13 and the photovoltaic cell 14 in order to connect the power source 35 to the electromagnet 7 and to cause movement of the armature 3 and the diaphragm 2 to an actuated position to effect a stroke of the pump and a pumping of the liquid. As soon as this occurs, the aperture 11 no longer is aligned between diode 13 and photovoltaic cell 14 so that the circuit is open to cause the return spring 33 to move the magnetic armature 3 back to a non-actuated position, thereby, effecting a return stroke of the pump. Thus, the pump is operated to effect a positive displacement of the liquid with very small pressure variations and at high frequency of operation and in a simple an reliable manner.

In order to adjust the stroke, the part of the piston rod 4, namely the part 4*b*, which is connected to armature 3, is threadedly connected to the part 4*a*. Part 4*b* may therefore be rotated to threadedly engage it into the part 4*b* and thus change the position of the aperture 11 relative to the diode 13 and the photovoltaic cell 14.

Figure 2:
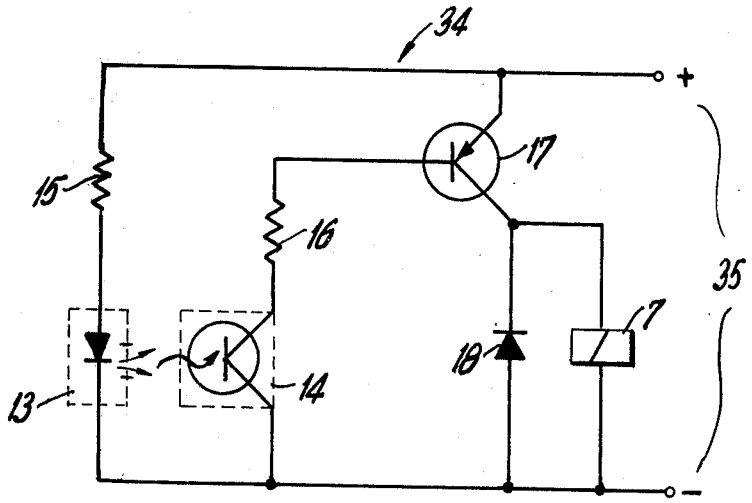
FIG. 2 is an electric control circuit for the pump shown in FIG. 1.

The electrical diagram shown in FIG. 2 indicates resistances 15 and 16 for the diode 13 and the cell 14, respectively, and also a transistor 17 and a diode 18.

While a specific embodiment of the invention has been shown and described in detail to illustrate the application of the principles of the invention, it will be understood that the invention may be embodied otherwise without departing from such principles.

What is claimed is:

1. A pump, comprising a housing having a pumping chamber with an inlet to said pumping chamber and a discharge from said pumping chamber, a pumping diaphragm having a portion arranged in said pumping chamber and being displaceable to pump liquid from said inlet to said pumping chamber and out said discharge, an electromagnet having an armature portion connected to said diaphragm, return spring means acting on said armature to move it away from said electromagnet, a power circuit connected to said electromagnet to energize said electromagnet and attract said armature portion to move it against said spring means and to flex said diaphragm to pump liquid, said power circuit having a photocell switch therein to connect and disconnect said electromagnet, said armature having a part with an opening movable by movement of said armature portion to and away from alignment with said photocell switch to cyclically actuate said photocell switch and said armature.

2. A pump according to claim 1, wherein said armature comprises a plate secured to said diaphragm, said armature including a piston rod extending outwardly from said plate and having the opening therein which may be aligned with and moved out of alignment with said photoelectric cell switch.

3. A pump according to claim 2, wherein said photocell switch includes a photodiode arranged on one side of said piston rod and a photovoltaic cell on the opposite side of said piston rod.

4. A pump according to claim 3, wherein the location of the opening along said piston rod is remote from said diaphragm.

5. A pump according to claim 4, wherein said piston rod includes two threadedly interengaged portions which may be threaded to an amount to vary the position of the opening in one of said portions relative to said photoelectric cell switch.

6. A pump according to claim 1, wherein said photoelectric cell switch comprises a diode arranged on one side of the opening and a photovoltaic cell arranged on the opposite side of the opening.

* * * * *